US011320238B1

(12) United States Patent
Bitsakis

(10) Patent No.: US 11,320,238 B1
(45) Date of Patent: May 3, 2022

(54) INTERNAL COUNTERMEASURE LAUNCHER HAVING A HYBRID RAM EJECTION PUMP

(71) Applicant: The United States of America as represented by the Secretary of the Navy, Newport, RI (US)

(72) Inventor: Nicholas Bitsakis, Seekonk, MA (US)

(73) Assignee: The United States of America as represented by the Secretary of the Navy

( * ) Notice: Subject to any disclaimer, the term of this patent is extended or adjusted under 35 U.S.C. 154(b) by 33 days.

(21) Appl. No.: 17/000,448

(22) Filed: Aug. 24, 2020

(51) Int. Cl.
*F41F 3/10* (2006.01)
*F41F 3/07* (2006.01)

(52) U.S. Cl.
CPC . *F41F 3/10* (2013.01); *F41F 3/07* (2013.01)

(58) Field of Classification Search
CPC ..... F41F 3/10; F41F 3/08; F41F 3/07; F41F 3/00
See application file for complete search history.

(56) References Cited

U.S. PATENT DOCUMENTS 2,194,217 A * 3/1940 Crane ..... B63H 25/28 114/144 R
5,375,502 A * 12/1994 Bitsakis ..... B63G 8/30 114/238
6,220,196 B1 * 4/2001 Escarrat ..... B63G 8/32 114/238
2003/0061981 A1 * 4/2003 Venier ..... B63G 8/41 114/312

* cited by examiner

*Primary Examiner* — Andrew Polay
(74) *Attorney, Agent, or Firm* — James M. Kasischke; Michael P. Stanley

(57) ABSTRACT

A launcher includes an impulse cylinder connected to a launch tube. An impulse piston, disposed within the impulse cylinder has a water side and an air side. The water side is in fluid communication with the launch tube. The air side is in fluid connection with a high pressure air source. A shaft connects a hydraulic cylinder is to the impulse cylinder. The shaft connects a hydraulic piston to the impulse piston. A control valve is connected to the hydraulic cylinder and controls movement of the hydraulic piston, which in turn controls movement of the impulse piston. Upon launch, the control valve allows movement of the hydraulic piston which allows movement of the impulse piston, providing water behind a projectile.

13 Claims, 3 Drawing Sheets

INTERNAL COUNTERMEASURE LAUNCHER HAVING A HYBRID RAM EJECTION PUMP

STATEMENT OF GOVERNMENT INTEREST

The invention described herein was made in the performance of official duties by employees of the U.S. Department of the Navy and may be manufactured, used, or licensed by or for the Government of the United States of America for any governmental purpose without payment of any royalties thereon.

CROSS REFERENCE TO OTHER PATENT APPLICATIONS

None.

BACKGROUND OF THE INVENTION

(1) Field of the Invention

This invention relates to submarine launchers and, more particularly, to a launch assembly using an air pressure balanced ejection pump.

(2) Description of the Prior Art

Submarines may have one or more countermeasure launchers or signal ejectors with multiple penetrations through the hull. Such penetrations may be used to provide seawater for the launcher and a large opening at the muzzle end of a launch tube to provide an exit for the projectile that is to be launched. When it is desired to launch a device from the launcher, seawater is allowed to enter one side of an ejection pump. Air from a flask of high pressure air is delivered to the ejection pump on the opposite side of a piston holding against the seawater. The air is delivered at a pressure greater than pressure of the seawater at the depth of the submarine. The high pressure air on the piston compresses the water into the breech end of the launch tube, which creates a pressure imbalance between the breech end of the device in the launch tube and the outside seawater. As a result of the pressure imbalance, the device is ejected from the launch tube.

As the depth of the submarine increases, so does the sea pressure, which increases the pressure on the muzzle end of the launch tube. As a result, the pressure requirement for launching a device from the launch tube increases with the depth of the submarine. The launcher must be able to achieve the necessary pressure for the device to exit the launch tube. Preferably, the launcher should be of an economically efficient design and be capable of remote firing with a short launch readiness time. The launcher should be configured to facilitate easy assembly and disassembly for maintenance and repair.

It is thus desirable to have an internal countermeasure launcher that minimizes hull penetrations, auxiliary hydraulic components, and provides a balance pressure launch.

SUMMARY OF THE INVENTION

The present disclosure describes a pneumatically powered, hydraulically assisted and controlled, fixed displacement ram ejection pump. The ejection pump capitalizes on the power and dynamic response available from utilization of air pressure, as well as control from the incorporation of the hydraulics.

According to an aspect of the invention, a projectile launching system includes a launch tube. An impulse cylinder is connected to the launch tube. An impulse piston is disposed within the impulse cylinder. The impulse piston has a water side and an air side. The water side is in fluid communication with the launch tube. The air side is in fluid connection with a high pressure air source. A hydraulic cylinder is operatively connected to the impulse cylinder. A hydraulic piston is disposed within the hydraulic cylinder. A shaft between the impulse cylinder and the hydraulic cylinder has a first end and a second end. The first end of the shaft is connected to the impulse piston and the second end of the shaft is connected to the hydraulic piston. A control valve is connected to the hydraulic cylinder and controls movement of the hydraulic piston, which in turn controls movement of the impulse piston.

According to an exemplary hybrid ram ejection pump herein, a first cylinder has a water impulse outlet aperture connected to a launch device and a high pressure air inlet aperture connected to a high pressure air source. A first piston is located in the first cylinder between the water impulse outlet aperture and the high pressure air inlet aperture. The first piston is moveable between a rest position and a launch position. A second cylinder is connected to the first cylinder. A second piston is located in the second cylinder. The second piston is moveable between a stop position and a firing position. A shaft connects the first piston to the second piston. A control valve is connected to the second cylinder. A controller is connected to the control valve.

According to an exemplary method herein, an impulse cylinder is connected to a launch tube. The impulse cylinder has a water side and an air side. The water side is at a pressure approximately equal to seawater pressure in the launch tube and the air side is at a pressure greater than approximately 100 psi more than the pressure in the launch tube. A piston is provided between the water side and the air side in the impulse cylinder. The piston has a shaft connected to a hydraulic control assembly. The piston is held in an at-battery position by exerting pressure on the shaft using the hydraulic control assembly. Responsive to an order to launch, the hydraulic control assembly releases the pressure on the shaft. Air on the air side of the impulse cylinder is allowed to expand and move the piston toward a launch position. As the piston moves toward the launch position, the piston forces water on the water side of the impulse cylinder into the launch tube. Acceleration and deceleration of the piston is controlled by adjusting the pressure on the shaft according to a predetermined velocity profile.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF INVENTION

Figure 1:
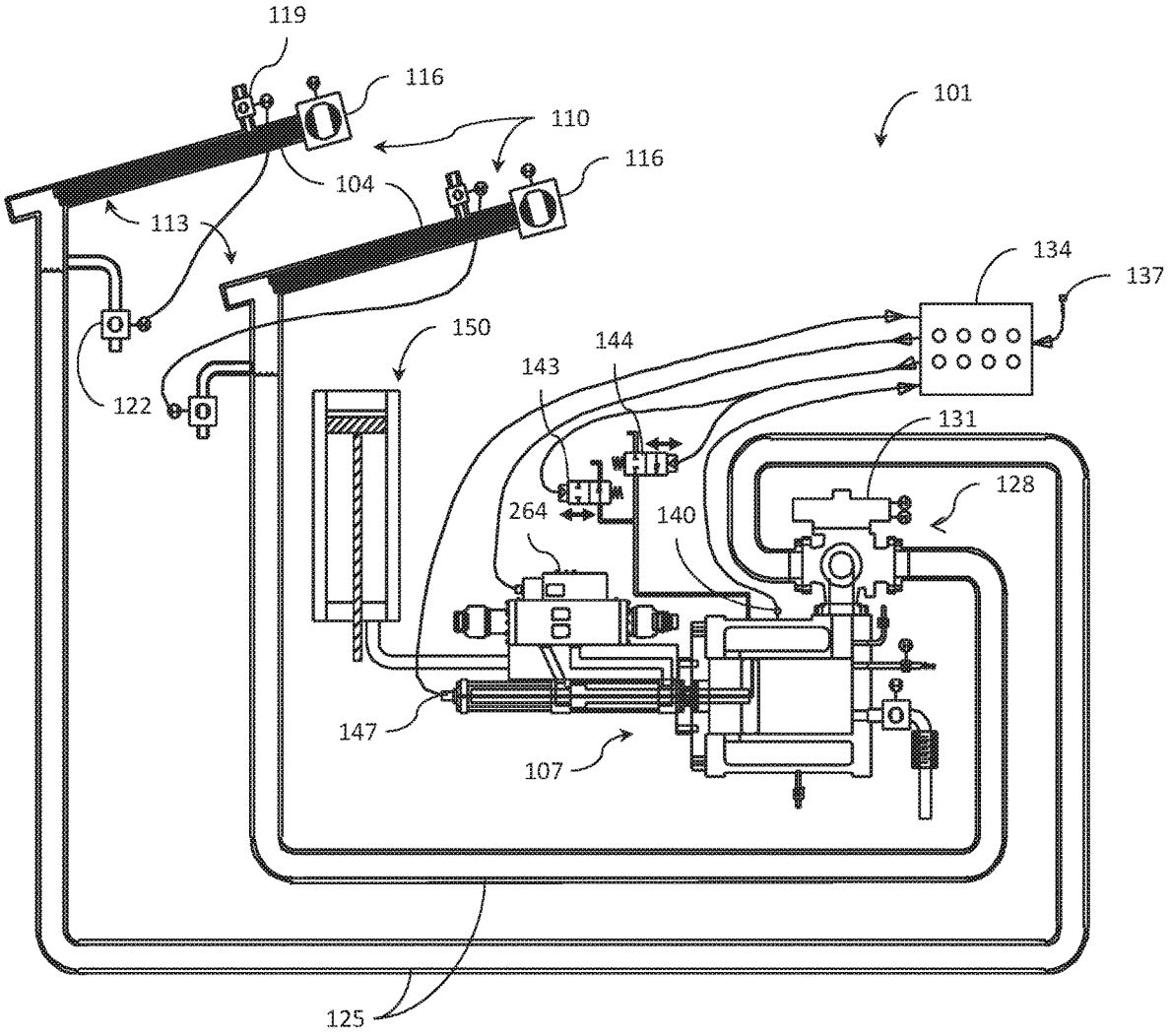
FIG. 1 shows a launch system according to devices and methods herein.

Referring to FIG. 1, a launch system, indicated generally as 101, includes one or more launch tubes 104 connected to an ejection pump 107. Each launch tube 104 has a muzzle end 110 and a breech end 113. For submarine systems, the muzzle end 110 can include a muzzle valve 116, which typically can be a hydraulically operated ball valve. The breech end 113 can include a breech door (not shown) for inserting a countermeasure device or other projectile for launching from the launch system 101. The launch tube 104 can also include a vent valve 119 and a drain valve 122.

The launch tube 104 is connected by piping 125 to the ejection pump 107 through an impulse isolation valve 128. The impulse isolation valve 128 can have a hydraulic operator 131 to select which launch tube 104 to direct the ejection impulse to.

Figure 2:
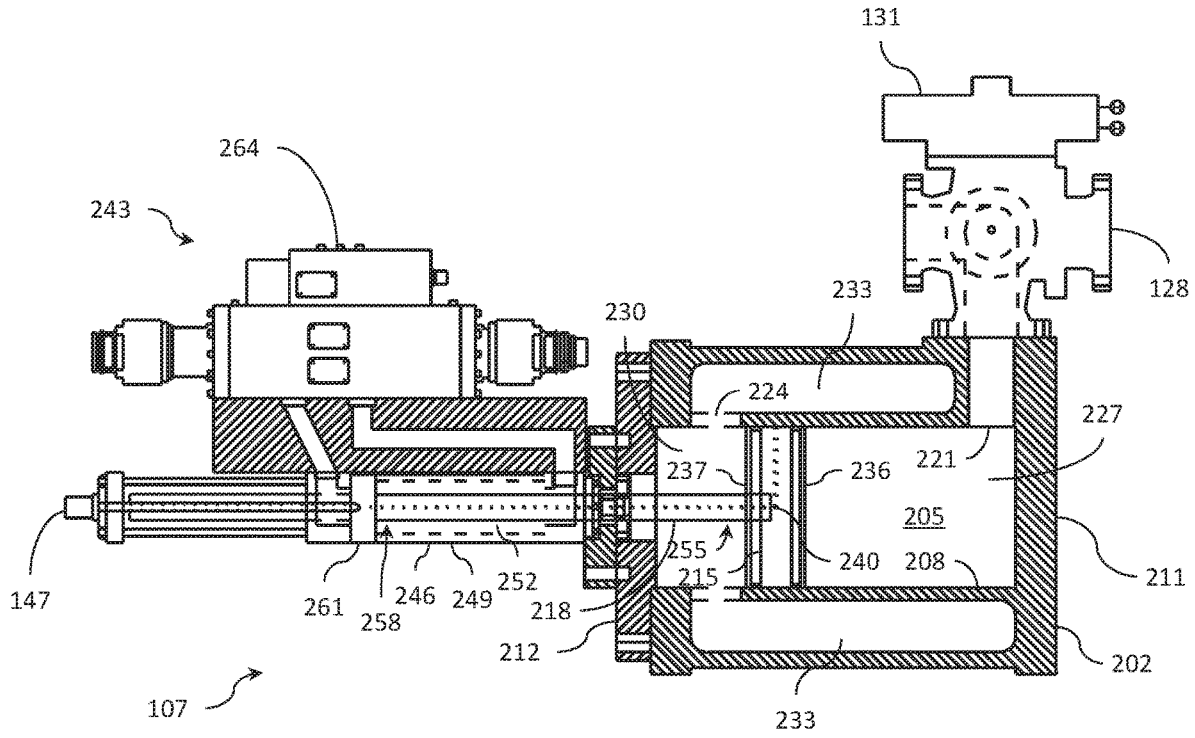
FIG. 2 shows a cut-away view of an ejection pump according to devices and methods herein.

As shown in FIG. 2, the ejection pump 107 includes a pump body 202 having an impulse cylinder 205 defined by a cavity wall 208. The cavity wall 208 is generally cylindrical and includes opposing end walls 211, 212. End walls 211, 212 conform to the shape of cavity wall 208. The impulse cylinder 205 is connected to the launch tube 104 by piping 125 through the impulse isolation valve 128.

An impulse piston 215 is disposed within the impulse cylinder 205. The impulse piston 215 has a cross-sectional shape generally conforming to the cavity wall 208, and is supported on a piston shaft 218. The impulse piston 215 and the piston shaft 218 are coaxially disposed within the impulse cylinder 205. The impulse piston 215 is slidable within the impulse cylinder 205 between a rest position and a launch position. The impulse cylinder 205 includes a water impulse outlet aperture 221 and a high pressure air inlet aperture 224. The impulse piston 215 divides the impulse cylinder 205 into a water side 227 and an air side 230. The water side 227 is in fluid communication with the launch tubes 104. The air side 230 is in fluid connection with a high pressure air source, such as air chamber 233.

The impulse piston 215 includes opposing surfaces 236, 237 with dual, low friction seals at the periphery of the surfaces 236 and 237 to seal against cavity wall 208. A bleed port 240 is provided between the opposing surfaces 236, 237. Any fluid leakage from the water side 227, or air leakage from the air side 230, is carried through the center of the piston shaft 218 to a gravity drain. This minimizes the possibility of water in the air side, and vice versa.

As shown in FIG. 2, the impulse cylinder 205 has a bore diameter of approximately 6-18 inches in which the impulse piston 215 rides. It has been found that increasing the piston diameter increases system efficiency. This is due to the fact that imbalance on the piston shaft 218 is minimized as the cylinder diameter grows.

Further, the stroke of the impulse piston 215 between the rest position and the launch position is approximately the same as the piston diameter. The stroke length is determined by the amount of water displacement required for launch, as well as the water column deceleration criterion. Minimizing stroke creates higher water column deceleration rates which increases risk of cavitation.

An air chamber 233 integral to the ejection pump 107 is much preferred over a separate air flask (not shown) with connecting piping for the efficient expansion of air into the air side 230 of the impulse cylinder 205. According to devices and methods herein, the air chamber 233 may have a volume of approximately three cubic feet. Another advantage of an air chamber 233 integral to the ejection pump 107 is simplified ship arrangements, due to minimization of the number of foundations required. Air chamber 233 is joined to a high pressure air system available on the vessel.

A hydraulic control assembly 243 is connected to the ejection pump 107. The hydraulic control assembly 243 is further joined to receive hydraulic fluid from a hydraulic pump or hydraulic pressure source that is commonly available aboard a vessel. The hydraulic control assembly 243 includes a hydraulic cylinder 246 operatively connected to the impulse cylinder 205. The hydraulic cylinder 246 includes a housing 249 defining an interior chamber 252. The piston shaft 218 extends through end wall 212 of the impulse cylinder 205 into the interior chamber 252 of the hydraulic cylinder 246. The piston shaft 218 has a first end 255 and a second end 258. The first end 255 is connected to the impulse piston 215 and the second end 258 is connected to a hydraulic piston 261 slidably disposed in the hydraulic cylinder 246. The hydraulic piston 261 is moveable between a stop position and a firing position. The hydraulic control assembly 243 includes a control valve 264 connected to the hydraulic cylinder 246. The control valve 264 controls and restrains movement of the hydraulic piston 261, which in turn controls and restrains movement of the impulse piston 215.

As shown in FIG. 2, the hydraulic cylinder 246 contains a hydraulic piston 261 that is approximately 3-5 inches in diameter with a piston shaft 218 approximately 1.5-3 inches in diameter. The hydraulic cylinder 246 may comprise a dual rod cylinder, which is preferred, to equalize hydraulic fluid flow through both inlet and outlet ports of the control valve 264. A dual rod cylinder also provides a path for any leakage flow from the impulse cylinder 205 to drain.

In a preferred embodiment, the control valve 264 comprises a hydraulic servo control valve close coupled to the hydraulic cylinder 246, for optimum hydraulic performance. Control of the control valve 264 is provided through a feedback control system, capable of command specific velocity profiles, as described below. Other types of control valves can be used.

The launch system 101 shown in the FIGs. is designed for compactness and length minimization. According to devices and methods herein, the mechanical components of the ejection pump 107 are the impulse cylinder 205, which houses the impulse piston 215, the hydraulic cylinder 246, which houses the hydraulic piston 261; and the control valve 264 that controls movement of the hydraulic piston 261, which in turn controls movement of the impulse piston 215. The mechanical configuration of the components may vary by design and by ship installation constraints.

Referring again to FIG. 1, a controller or a control panel 134 is connected to the control valve 264 and a plurality of sensors. Transducers or other appropriate devices that measure sea pressure, such as at 137, and pressure in the air chamber 233, such as sensor 140 may be monitored by the control panel 134. The control panel 134 maintains pressure in the air chamber 233 by operation of dual solenoid control valves 143, 144. One of the solenoid control valves, such as 143, can be used to maintain the air pressure in the air chamber 233 to a pressure required for launch. After operation of the launch system 101, air can be vented through the other of the solenoid control valves, such as 144.

FIG. 2 shows the ejection pump 107 in the at-battery position (ready to fire). When ready to fire, the sea water (on the water side 227 of the impulse piston 215) is at sea pressure. The air pressure (on the air side 230 of the impulse piston 215) is a function of depth pressure. That is, the water side 227 is at pressure approximately equal to seawater pressure in the launch tube 104 and the air side 230 is at a pressure greater than approximately 100 psi to 150 psi more than the pressure in the launch tube 104. This pressure imbalance on the impulse piston 215 is countered by hydraulic pressure on the hydraulic piston 261 in the hydraulic cylinder 246, causing the impulse piston 215 and hydraulic piston 261 to remain motionless. When launch is commanded, the hydraulic control assembly 243 causes the control valve 264 to release the pressure on the hydraulic piston 261. This allows the air in the air chamber 233 to expand, and causes the impulse piston 215 to move the impulse piston 215 toward a launch position. The hydraulic control assembly 243 resists motion of the impulse piston 215 from prior to time of launch and through at least a portion of the launch stroke. The hydraulic control assembly 243 assists in motion of the impulse piston 215 during the latter portion of the launch stroke, controlling system dynamics and preventing a rapid deceleration/cavitation/mechanical contacting in the sea water using a predetermined launch profile. Numerous launch pulses can be obtained through appropriate feedback selection.

A position sensor 147, may be used to determine the position and direction of motion (if any) of the piston shaft 218. Upon receiving position indicating signals, the control panel 134 provides a control signal to the hydraulic control assembly 243. Thus, position of the piston shaft 218 and correspondingly the position of the impulse piston 215 may be sensed by the position sensor 147 and used to control the flow of hydraulic fluid in the hydraulic control assembly 243. In some embodiments, the position sensor may be a mechanical position indicating device, such as wheel, or an electronic position indicating device, such as a magnetic or photoelectric device, or a displacement transducer.

The launch system 101 may include a dedicated hydraulic accumulator 150 in the vicinity of the ejection pump 107 providing hydraulic fluid under pressure to the control valve 264. The hydraulic accumulator 150 can provide the high flow rate, short duration, hydraulic fluid requirements of the ejection pump 107. The size of the hydraulic accumulator 150 may be approximately 2-6 gallons.

As shown in the FIGs., the impulse isolation valve 128 is at a right angle to the centerline of the impulse cylinder 205. This provides a minimum length for the ejection pump 107. Alternatively, if length is available in the desired location, the impulse isolation valve 128 can be on the centerline of the impulse cylinder 205. In addition, the hydraulic cylinder 246 is shown close coupled to the impulse cylinder 205. This is a preferred arrangement to simplify ship installation and to minimize shaft alignment issues.

Figure 3:
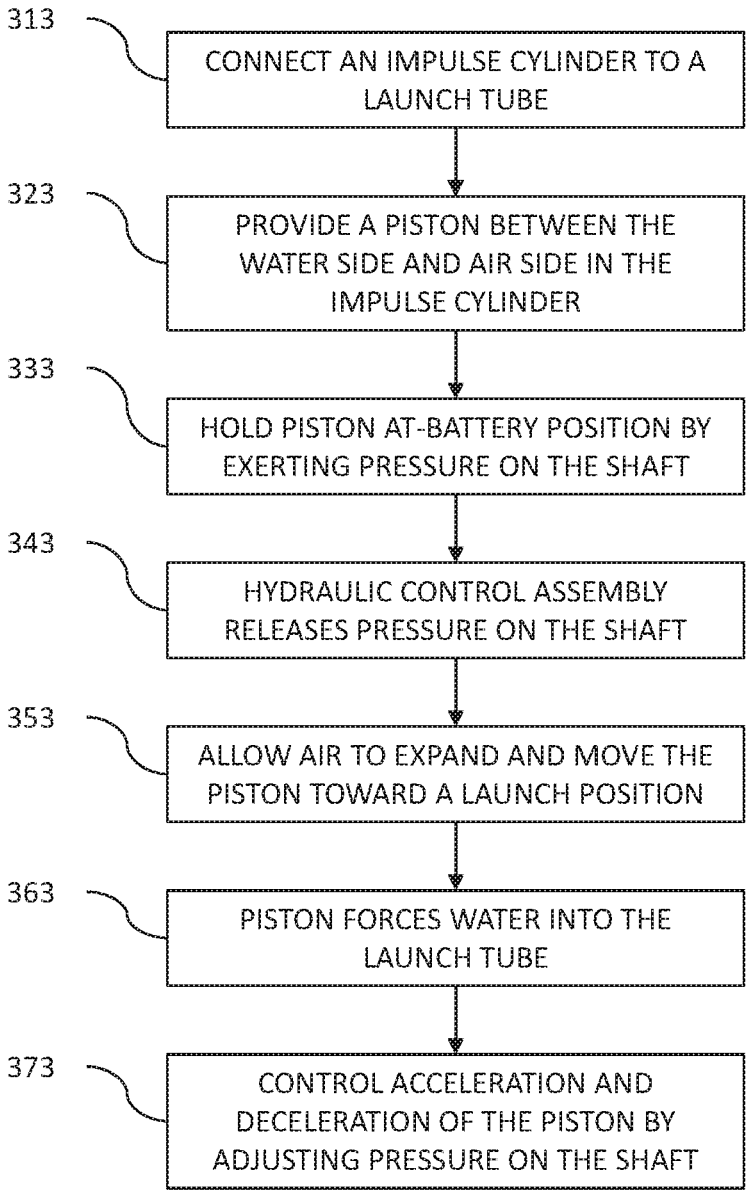
FIG. 3 is a flow chart illustrating a specific embodiment of the invention herein.

FIG. 3 is a flow chart illustrating a specific embodiment of the invention herein. At 313, an impulse cylinder is connected to a launch tube. The impulse cylinder has a water side and an air side. The water side is at a pressure approximately equal to seawater pressure in the launch tube and the air side is at a pressure greater than approximately 100 psi more than the pressure in the launch tube. At 323, a piston is provided between the water side and the air side in the impulse cylinder. The piston has a shaft connected to a hydraulic control assembly. At 333, the piston is held in an at-battery position by exerting pressure on the shaft using the hydraulic control assembly. Responsive to an order to launch, the hydraulic control assembly releases the pressure on the shaft, at 343. Air on the air side of the impulse cylinder is allowed to expand and move the piston toward a launch position, at 353. As the piston moves toward the launch position, the piston forces water on the water side of the impulse cylinder into the launch tube, at 363. Acceleration and deceleration of the piston is controlled by adjusting the pressure on the shaft according to a predetermined velocity profile, at 373.

The invention has been described with references to specific embodiments. While particular values, relationships, materials, and steps have been set forth for purposes of describing concepts of the present disclosure, it will be appreciated by persons skilled in the art that numerous variations and/or modifications may be made to the invention as shown in the disclosed embodiments without departing from the spirit or scope of the basic concepts and operating principles of the invention as broadly described. It should be recognized that, in the light of the above teachings, those skilled in the art could modify those specifics without departing from the invention taught herein. Having now fully set forth certain embodiments and modifications of the concept underlying the present disclosure, various other embodiments as well as potential variations and modifications of the embodiments shown and described herein will obviously occur to those skilled in the art upon becoming familiar with such underlying concept. It is intended to include all such modifications, alternatives, and other embodiments insofar as they come within the scope of the appended claims or equivalents thereof. It should be understood, therefore, that the invention might be practiced otherwise than as specifically set forth herein. Consequently, the present embodiments are to be considered in all respects as illustrative and not restrictive.

The terminology used herein is for the purpose of describing particular systems and methods only and is not intended to be limiting of this disclosure. As used herein, the singular forms "a", "an", and "the" are intended to include the plural forms as well, unless the context clearly indicates otherwise. It will be further understood that the terms "comprises", "comprising", "includes", and/or "including", when used in this specification, specify the presence of stated features, integers, steps, operations, elements, and/or components, but do not preclude the presence or addition of one or more other features, integers, steps, operations, elements, components, and/or groups thereof. Further, the terms "automated" or "automatically" mean that once a process is started (by a machine or a user); one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various embodiments herein have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

For example, terms such as "right", "left", "vertical", "horizontal", "top", "bottom", "upper", "lower", "under", "below", "underlying", "over", "overlying", "parallel", "perpendicular", etc., as used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements).

Finally, any numerical parameters set forth in the specification and attached claims are approximations (for example, by using the term "about") that may vary depending upon the desired properties sought to be obtained by the present disclosure. At the very least, and not as an attempt to limit the application of the doctrine of equivalents to the scope of the claims, each numerical parameter should at least be construed in light of the number of significant digits and by applying ordinary rounding.

What is claimed is:

1. A projectile launching system, comprising:

a launch tube;

an impulse cylinder connected to said launch tube;

a high pressure air source joined to said impulse cylinder;

an impulse piston positioned within said impulse cylinder, said impulse piston defining a water side and an air side within said impulse cylinder, said water side being in fluid communication with said launch tube, said air side being in fluid connection with said high pressure air source;

a hydraulic cylinder;

a hydraulic piston within said hydraulic cylinder;

a shaft having a first end and a second end, said first end being connected to said impulse piston and said second end being connected to said hydraulic piston;

a hydraulic source;

a hydraulic accumulator joined to said hydraulic source for providing pressurized hydraulic fluid; and a control valve joined between said hydraulic source and said hydraulic cylinder for providing pressurized hydraulic fluid for controllable movement of said hydraulic piston.

2. The system according to claim 1, wherein said hydraulic cylinder is in direct contact with said impulse cylinder and said shaft length is minimized.

3. The system according to claim 1, wherein said impulse cylinder has a water impulse outlet aperture therein to allow communication between said launch tube and said impulse piston water side, a high pressure air inlet aperture formed therein to allow communication between said high pressure air source and said impulse piston air side.

4. The system according to claim 1, further comprising a controller connected to operate said control valve.

5. The system according to claim 4, wherein said controller is capable of controlling acceleration and deceleration of said hydraulic piston according to a predetermined velocity profile.

6. The system according to claim 4, wherein said control valve comprises a hydraulic servo control valve coupled to said hydraulic cylinder, said hydraulic servo control valve being operatively connected to said controller for directing fluid flow of hydraulic fluid in said hydraulic cylinder.

7. The system according to claim 4, further comprising a position sensor in communication with said controller, said position sensor being positioned to determine a position of said shaft and transmitting a signal associated with said position of said shaft to said controller.

8. A hybrid ram ejection pump for a vessel, comprising:

a launch chamber in the vessel;

a high pressure air source in the vessel;

a first cylinder having a water impulse outlet aperture formed therein allowing communication with said launch chamber, and a high pressure air inlet formed therein allowing communication with said high pressure air source;

a first piston located in said first cylinder between said water impulse outlet aperture and said high pressure air inlet aperture, said first piston being moveable between a rest position and a launch position;

a second cylinder having a chamber defined therein;

a second piston located in said second cylinder chamber, said second piston being moveable between a stop position and a firing position;

a shaft connecting said first piston to said second piston;

hydraulic fluid in said second cylinder chamber;

a control valve connected to said second cylinder to provide hydraulic fluid under pressure to selectively allow movement of said second piston between the stop position to the firing position;

a hydraulic accumulator providing hydraulic fluid under pressure to said control valve; and a controller connected to said control valve to control selectable provision of hydraulic fluid.

9. The apparatus according to claim 8, wherein said controller controls said control valve to selectively provide hydraulic fluid to control acceleration and deceleration of said second piston according to a predetermined velocity profile.

10. The apparatus according to claim 8, wherein said control valve comprises a hydraulic servo control valve in direct communication with said second cylinder chamber, said hydraulic servo control valve being operatively connected to said controller for directing fluid flow of hydraulic fluid in said second cylinder.

11. The apparatus according to claim 8, wherein said first piston has opposing surfaces and a bleed port communicating between the opposing surfaces.

12. The apparatus according to claim 8, wherein said control valve has an inlet port in communication with said second cylinder chamber on one side of said second piston and an outlet port in communication with said second cylinder chamber on another side of said second piston.

13. The apparatus according to claim 8, further comprising:

a position sensor positioned proximate said shaft and in communication with said controller, said position sensor being capable of detecting a position of said shaft and transmitting a signal associated with said position of said shaft to said controller.

* * * * *